US005740315A

United States Patent [19]

Onishi et al.

[11] Patent Number: 5,740,315

[45] Date of Patent: Apr. 14, 1998

[54] FLUID HEATING APPARATUS

[75] Inventors: Tetsuo Onishi; Hiromasa Takamatsu; Makio Tsubota, all of Kanagawa-ken, Japan

[73] Assignee: Kabushiki Kaisha Komatsu Seisakusho, Tokyo, Japan

[21] Appl. No.: 356,247

[22] PCT Filed: Jun. 29, 1993

[86] PCT No.: PCT/JP93/00894

§ 371 Date: Dec. 22, 1994

§ 102(e) Date: Dec. 22, 1994

[87] PCT Pub. No.: WO94/00720

PCT Pub. Date: Jan. 6, 1994

[30] Foreign Application Priority Data

Jun. 30, 1992 [JP] Japan ..... 4-172560

[51] Int. Cl.[6] ..... F24H 1/10

[52] U.S. Cl. ..... 392/489; 392/483; 392/490; 219/298

[58] Field of Search ..... 392/485, 486, 392/487, 488, 489, 483, 500, 490, 449, 450, 451, 453, 456; 362/455, 377; 248/50, 74.2; 165/135, 61; 122/169, 175; 134/95; 204/130; 219/298; 137/340, 341; 210/188

[56] References Cited

U.S. PATENT DOCUMENTS

| | | | |
|---|---|---|---|
| 1,684,963 | 9/1928 | Luehrs | 392/486 |
| 2,813,964 | 11/1957 | Cerulli | 219/38 |
| 3,782,452 | 1/1974 | Ceplon | 165/135 |
| 4,095,087 | 6/1978 | Giraud | 219/298 |
| 4,129,178 | 12/1978 | Hucke | 165/61 |
| 4,567,350 | 1/1986 | Todd, Jr. | 392/486 |
| 4,855,023 | 8/1989 | Clark et al. | 204/130 |
| 4,917,123 | 4/1990 | McConnell et al. | 134/95 |
| 4,940,473 | 7/1990 | Benham | 210/188 |
| 5,054,107 | 10/1991 | Batchelder | 392/483 |

FOREIGN PATENT DOCUMENTS

| | | | |
|---|---|---|---|
| 209116 | 9/1956 | Australia . | |
| 0418179 | 3/1991 | European Pat. Off. | 392/485 |
| 1108348 | 6/1961 | Germany | 392/490 |
| 57-29245 | 6/1982 | Japan . | |
| 60-23748 | 2/1985 | Japan . | |
| 61-165529 | 7/1986 | Japan . | |
| 62-22462 | 2/1987 | Japan . | |
| 178420 | 12/1989 | Japan . | |
| 2-52437 | 4/1990 | Japan . | |
| 2-290434 | 11/1990 | Japan . | |
| 3-78537 | 12/1991 | Japan . | |
| 4-338282 | 11/1992 | Japan . | |
| 1523763 | 9/1978 | United Kingdom . | |

OTHER PUBLICATIONS

International Search Report, Sep. 21, 1993.

*Primary Examiner*—Tu B. Hoang

*Attorney, Agent, or Firm*—Fish & Richardson P.C.

[57] ABSTRACT

A fluid heating apparatus in which a heating unit (2) and a fluid supply adjusting unit (3) are accommodated in a casing in a manner separated from each other and connected through a flow-in tube (8) and a flow-out tube (9) and the fluid supply adjusting unit (3) is arranged vertically upward and downward on the side of the heating unit (2).

15 Claims, 8 Drawing Sheets

FLUID HEATING APPARATUS

TECHNICAL FIELD

The present invention relates to fluid heating apparatus for heating mainly pure water and chemical liquid, and more particularly, to fluid heating apparatus adapted to be used for washing liquid temperature adjusting apparatus for production of semiconductors, chemical liquid temperature adjusting apparatus, plating liquid adjusting apparatus, liquid temperature adjusting apparatus for production of foods, etc.

BACKGROUND TECHNOLOGY

For example, as a washing liquid temperature adjusting apparatus for production of semiconductors, there is provided one having a structure in which the heating vessel is formed of a quartz glass in a view point of prevention of contamination of a liquid to be heated and a heater as a heating source is disposed in a quartz glass tube so as not to directly contact the liquid. Furthermore, in a view point of improvement of heating efficiency, a halogen lamp has been increasingly utilized in place of a heater with a nichrome wire as a heating source.

As a conventional fluid heating apparatus of the structure described above, one example is disclosed in the Japanese Utility Model Laid-open Publication No. HEI 2-52437, and in this example, as shown in FIG. 1, a heating vessel h is commonly utilized as a treating tank for a material to be washed and a heater b is inserted into a quartz glass tube a.

Another example such as disclosed in the Japanese Utility Model Laid-open Publication No. SHO 62-22462 is, as shown in FIG. 2, a continuous heating apparatus in which a plurality of heating vessels i, in each of which a heater d is disposed in a double-walled hollow tube c made of a quartz glass, are connected so as to continuously heat the fluid.

Furthermore, there is provided another prior art showing a continuous heating apparatus for increasing heating ability, in which, as shown in FIG. 3, a plurality of heating vessels g are connected in series, and in each of the heating vessels g, a plurality of inner tubes f are disposed, so as to be freely taken in and out, in an outer tube e formed of a quartz glass and heaters j each composed of a halogen lamp and disposed in each of the inner tubes f.

However, the prior art mentioned above involves problems of (1) enlargement of a dimension of the apparatus, (2) air-bubble staying or liquid staying, and these problems are mentioned hereunder respectively.

(1) Enlargement of Apparatus

It is inevitable to utilize a quartz glass to prevent contamination of a fluid to be heated as shown in FIG. 1 and disclosed in the Japanese Utility Model Laid-open Publication No. HEI 2-52437, but in such case, the heating vessel h also serves as a treating tank for a material to be washed, resulting in an enlargement of the heating vessel h.

Furthermore, in the apparatus shown in FIG. 2 and disclosed in the Japanese Utility Model Laid-open Publication No. SHO 62-22462, the heating vessel i is disposed with an inclination so as to make smooth the fluid flow in the heating vessel and to prevent air-bubble escape and liquid staying, but in this case, the inclinations of the respective heating vessels i have different orientations providing a zigzag appearance at a time when a plurality of heating vessels i are arranged, thus making large a pitch between adjacent heating vessels i, requiring much space.

In addition, in the apparatus of the Japanese Utility Model Laid-open Publication No. SHO 62-22462, the heating vessels i increased in number are arranged for achieving highly improved heating efficiency, but a long duct for connection between the respective heating vessels i is utilized, so that in a case where a plurality of heating vessels i are arranged, an entire height of the heating apparatus becomes large, thus providing a problem.

Still furthermore, in the apparatus of the structure shown in FIG. 3, the heating vessel g comprises the outer tube e made of quartz glass and a plurality of inner tubes f disposed inside the outer tube e and the heaters j are arranged therein to constitute the heating vessel g as a single unit to obtain a large output. A plurality of such heating vessels g are arranged in an adjacent manner to perform a continuous heating to a fluid of large volume. However, such continuous adjacent arrangement makes large the pitch between the adjacent heating vessels i, thus increasing entire volume of the heating apparatus and enlarging the same, also providing a problem.

(2) Air-Bubble Staying and Liquid Staying

In the heating apparatus of the structure shown in FIG. 3, since the respective heating vessels g are horizontally arranged, air-bubbles likely stay to the upper portions of the respective heating vessels g, and more particularly, in a case when the liquid is boiled, a large amount of generated air-bubbles hardly flow out, thus being dangerous. Furthermore, there is provided a problem of easy staying of the liquid in the heating vessel g.

The present invention aims to provide a fluid heating apparatus including a conventional heating vessel of a structure provided with a halogen lamp and a quartz glass and being capable of, in view of elimination of contamination of a liquid to be heated and continuous heating of liquid with high efficiency, making compact the heating apparatus in an assumption of use in a clean room, eliminating an enlargement of the apparatus particularly cased in the case of requiring an increasing heating ability, eliminating a problem of air-bubble staying and liquid staying in the heating vessel and a duct system, further improving the heating efficiency, and elongating a use life time of a heater.

DISCLOSURE OF THE INVENTION

In order to achieve the above and other objects, according to the present invention, there is provided a fluid heating apparatus wherein a heating unit and a fluid supply adjusting unit are accommodated in a casing in a manner of being separated from each other and being connected through a flow-in tube and a flow-out tube and the fluid supply adjusting unit is arranged on the side of the heating unit or arranged vertically upward and downward on the side of the heating unit.

According to this structure, since the fluid supply adjusting unit is arranged on the side of the heating unit or vertically upward and downward on the side of the heating unit, the fluid heating apparatus, in which the heating unit and the fluid supply adjusting unit are accommodated in its casing, can be entirely made thin. Furthermore, the heating unit and the fluid supply adjusting unit can be assembled and maintained in the casing in an improved manner.

The location of a heat shield plate between the heating unit and the fluid supply adjusting unit make narrow the gap between the heating unit and the fluid supply adjusting unit in the casing, thus making compact the apparatus.

Furthermore, the aforementioned heating unit comprises a plurality of heating vessels, a flow-in tube of one of adjacent heating vessels is connected to a flow-out tube of another one of the adjacent heating vessels, the flow-in tube and the flow-out tube being disposed so as to extend sideway of the heating unit, and end portions of the flow-in tube and the flow-out tube are offset in the same direction, so that the joint portions of the flow-in tubes and the flow-out tubes of the heating unit and the respective fluid supply unit vessels are positioned on the side of the heating vessel, whereby the gap in the vertical direction of the respective heating vessels can be made small and the size in the height direction of the heating unit can be made small.

There is also provided a fluid heating apparatus wherein a heating unit and a fluid supply adjusting unit are accommodated in a casing in a manner of being separated from each other and being connected through a flow-in tube and a flow-out tube, a heating vessel of the heating unit is arranged so that an axis of the heating vessel is inclined in a vertical direction, the flow-in tube being connected to a lower surface of a lower end portion of the heating vessel and the flow-out tube being connected to an upper surface of an upper end portion of the heating vessel, and the flow-in tube and the flow-out tube are inclined so that downstream sides thereof are positioned higher than upstream sides thereof.

According to this structure, the fluid passing the heating unit does not stay in the heating vessel of the heating unit, and the air-bubbles can smoothly flows out of the heating vessel. Furthermore, the fluid passing at the joint portions between the flow-in tube and the flow-out tube with respect to The heating vessel can be made smooth, and the air-bubbles do not also stay there.

Furthermore, the air-bubbles formed at the fluid heating time can be separated and removed at the time of flowing out of the heating unit by locating an air-bubble separation/removal device on a downstream side of the heating unit.

There is also provided a fluid heating apparatus, wherein a heating unit and a fluid supply adjusting unit are accommodated in a casing in a manner separated from each other and connected through a flow-in tube and a flow-out tube, and the flow-in tube and the flow-out tube are connected to an outer tube of the heating vessel of the heating unit in tangential directions respectively of the outer tube, and tube wall surfaces of the flow-in tube and the flow-out tube at portions jointed to the outer tube are formed to provide bent surfaces.

According to this structure, the flows of the fluid into and from the heating vessel constitute gyration flows with respect to the axis of the heating vessel, so that the heating efficiency in the heating vessel can be improved.

Furthermore, in the heating vessel of the heating unit, an inner tube is disposed in an outer tube closed at its both ends with side plate so as to penetrate through the side plates, a heater is disposed inside the inner tube, a halogen lamp is utilized as the heater, both ends of the halogen lamp being supported by the inner tube through a spring-like supporting member, and seal portions projecting from both the ends are completely exposed externally of the inner tube.

According to this structure, the body of the halogen lamp and the seal portion thereof can be sufficiently cooled, thus elongating the life time of the halogen lamp, and easily detaching and assembling the same.

BRIEF DESCRIPTION OF THE DRAWINGS

The present invention will become more understandable through the following detailed description and with reference to the accompanying drawings representing embodiments of the present invention. Further, it is to be noted that the embodiments shown in the accompanying drawings do not intend to specify the invention but intend to show ones for easy understanding of the disclosure.

In the accompanying drawings.

BEST MODE FOR EMBODYING THE INVENTION

Figure 1:
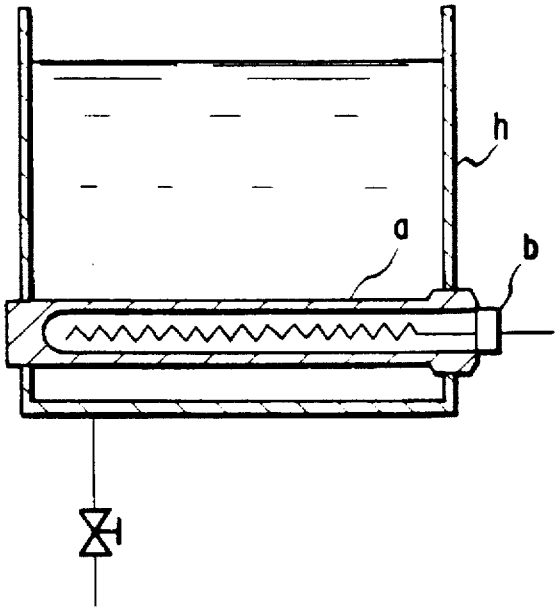
FIG. 1 is a sectional view showing a conventional example in which a quartz glass vessel and a heater are combined.
Figure 2:
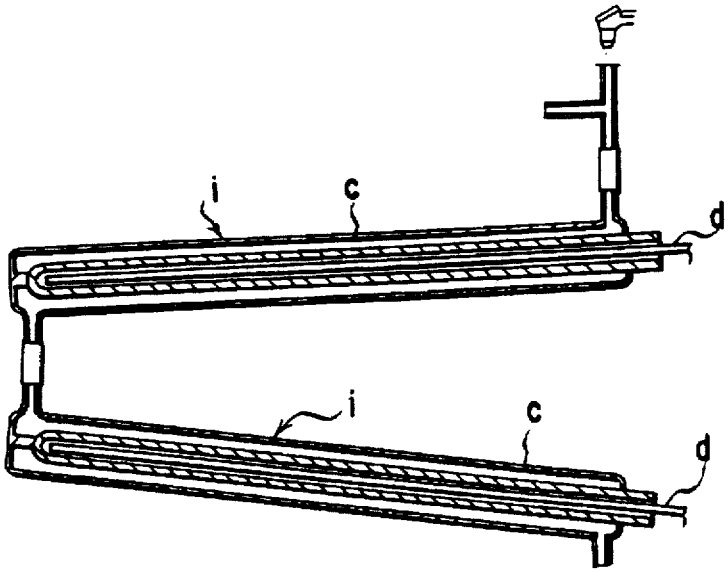
FIG. 2 is a sectional view showing a conventional example in which a heater is arranged in an inner tube of a double-tube type heating vessel made of quartz glass and a plurality of such heating vessels are connected.

Hereunder, a fluid heating apparatus according to a preferred embodiment of the present invention will be described with reference to FIGS. 4 to 11.

In the figures, numeral 1 denotes a casing of a fluid heating apparatus. In the casing 1, a heating unit 2 comprising a plurality of heating vessels 2*a*, 2*a* connected in series in a vertical direction is disposed to a lateral one side in the casing 1 and, to the other side therein, a fluid supply adjusting unit 3 for carrying out supply circulation of the fluid to the heating vessels 2*a*, 2*a* of the heating unit 2. A heat shield plate 4 is provided between both the units.

Figure 6:
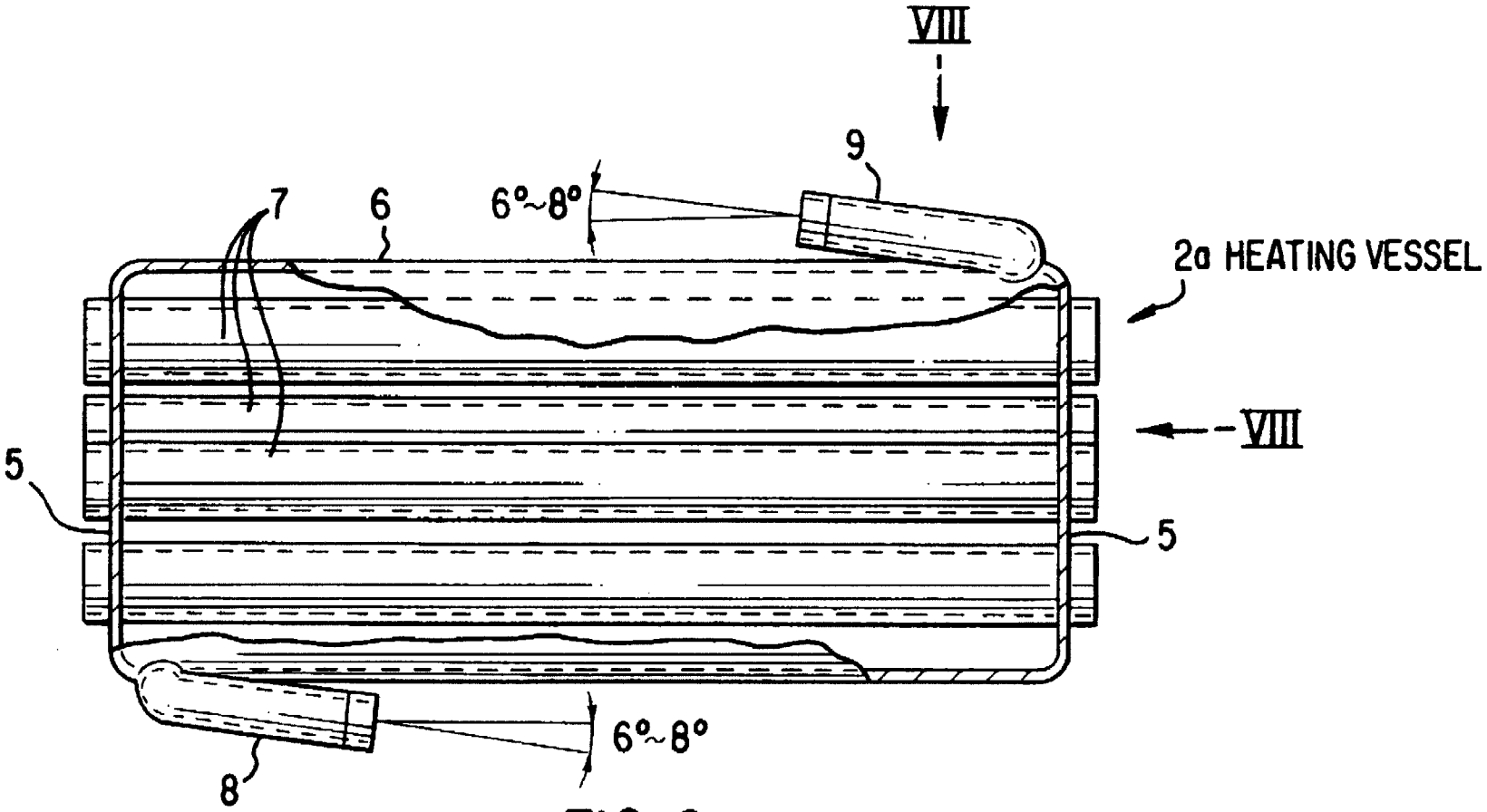
FIG. 6 is a front view, partially cut away, of a heating vessel of the above embodiment.
Figure 7:
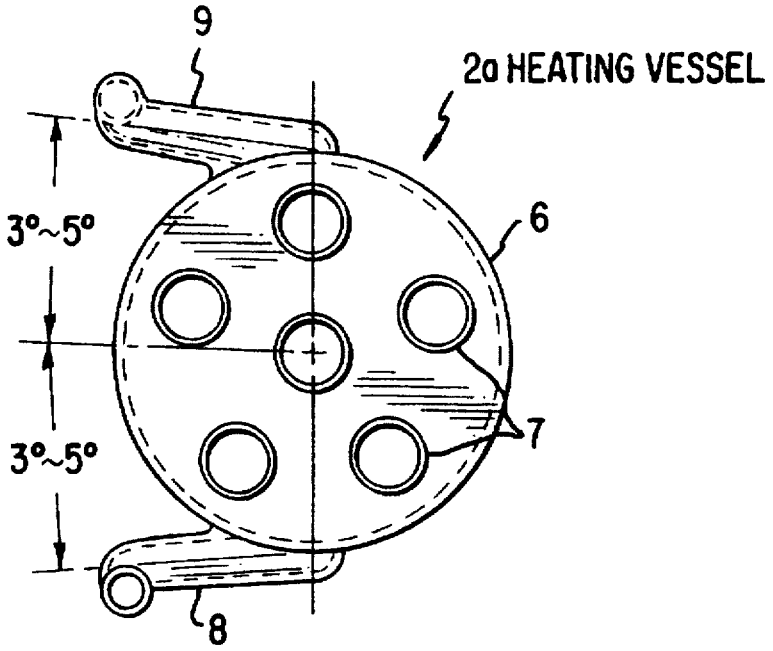
FIG. 7 is a view viewed from an arrowed direction VII in FIG. 6.
Figure 8:
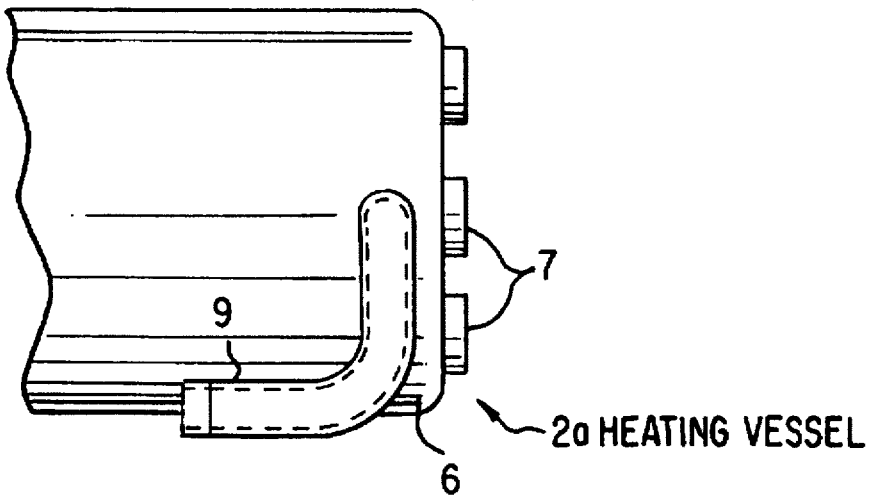
FIG. 8 is a view viewed from an arrowed direction VIII in FIG. 6.

Each of the heating vessel 2*a* of the heating unit 2 comprises, as shown in FIGS. 6 through 8, a cylindrical outer tube 6 closed at its both ends with side plates 5, 5, a plurality of inner tubes 7 penetrating the side plates 5, 5 into the outer tube 6 in parallel to the central axis of the outer tube 6, a flow-in tube 8 connected to a lower surface of an end portion of the outer tube 6, and a flow-out tube 9 connected to an upper surface of the end portion of the outer tube 6.

All the structural members of the heating vessel 2*a* are formed of a quartz glass material and are joined by means of welding. The number of the inner tubes 7 may be optionally selected in accordance with an inner diameter of the outer tube 6, and the respective inner tubes 7 are arranged so that thicknesses of the fluid covering the inner tubes 7, i.e. gaps each between the adjacent inner tubes 7 are substantially equal to each other.

As is apparent from FIG. 7, respective base end portions of the flow-in tube 8 and the flow-out tube 9 are connected to the lower surface of one end portion of the outer tube 6 and to the upper surface of the other one end of the outer tube 6 at a position crossing the vertical central axis (diameter) in the cross sectional shape of the outer tube 6. Both the tubes 8 and 9 extend on one side of the above-mentioned central axis. Further, the base end portions are directed respectively to tangential directions inclined with 3°–5° in directions apart from each other with respect to the horizontal central axis of the outer tube 6. Furthermore, the base end portions of both the tubes 8 and 9 are bent along the outer tube 6 but in directions opposite to each other, and in respect of the flow-in tube 8, a downward inclination of 6°–8° is made with respect to the central axis of the outer tube 6, and in respect of the flow-out tube 9, an upward inclination of 6°–8° is made with respect to the central axis of the outer tube 6.

Figure 9:
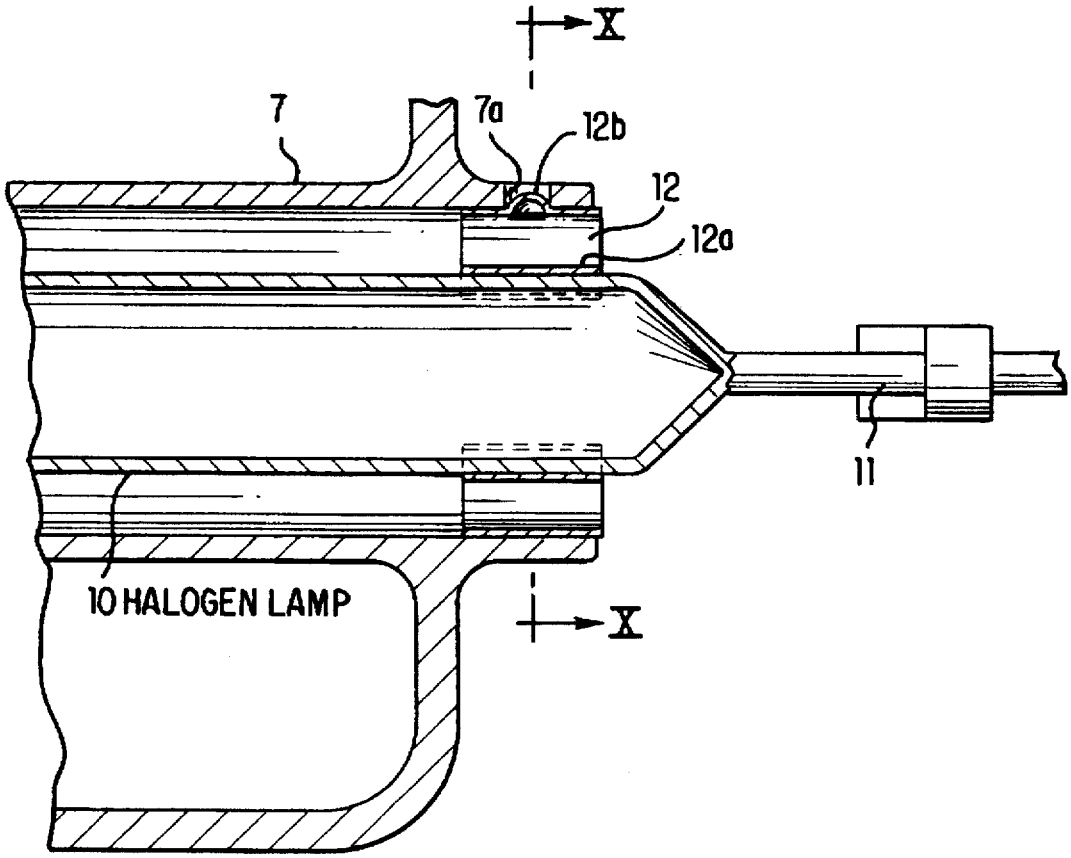
FIG. 9 is a sectional view of a support structure for a halogen lamp as a heater of the above embodiment.
Figure 10:
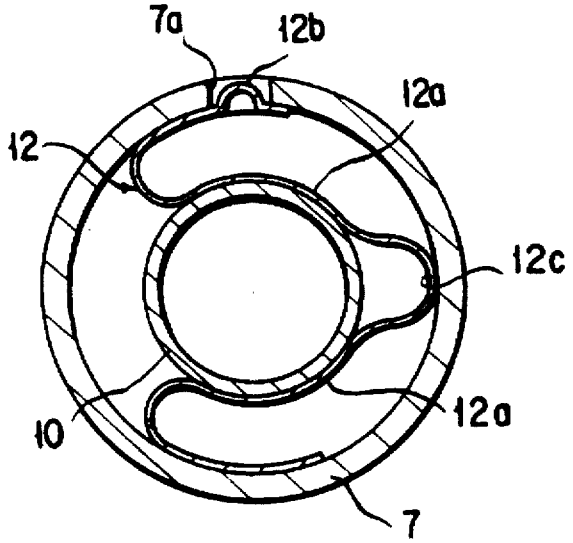
FIG. 10 is a sectional view taken along the line X—X in FIG. 9.

A halogen lamp 10 constituting a heater is inserted into each of the inner tubes 7 of the heating vessel 2*a* and supported therein. A structure for supporting the halogen lamp is shown in FIG. 9, in which seal portions 11 projecting from both ends of the halogen lamp 10 are completely exposed to the outside of the inner tube 7 and both end portions of the halogen lamp 10 are supported by a spring-shaped supporting member 12 at the axial portion of the inner tube 7. The spring-shaped supporting member 12 is composed of a plate spring, for example, and is bent as shown in FIG. 10, and heater supporting portions 12*a* for nipping a tube wall of the halogen lamp 10 are formed on both sides of an intermediate portion 12*c* of the bent portion so that the supporting member has a shape such that the bent intermediate portion 12*c* and both the front end portions abut against the inner surface of the inner tube 7, and a projection 12*b* to be engaged with a cutout 7*a* formed to the inner tube 7 is formed to one of the front end portions of the supporting member 12.

Figure 11:
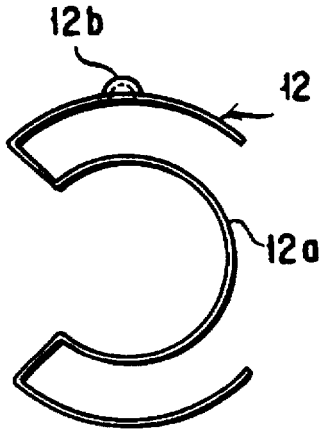
FIG. 11 is a front view showing another example of a spring-shaped supporting member for supporting the halogen lamp.

The spring-shaped supporting member 12 may have a shape shown in FIG. 11.

Figure 3:
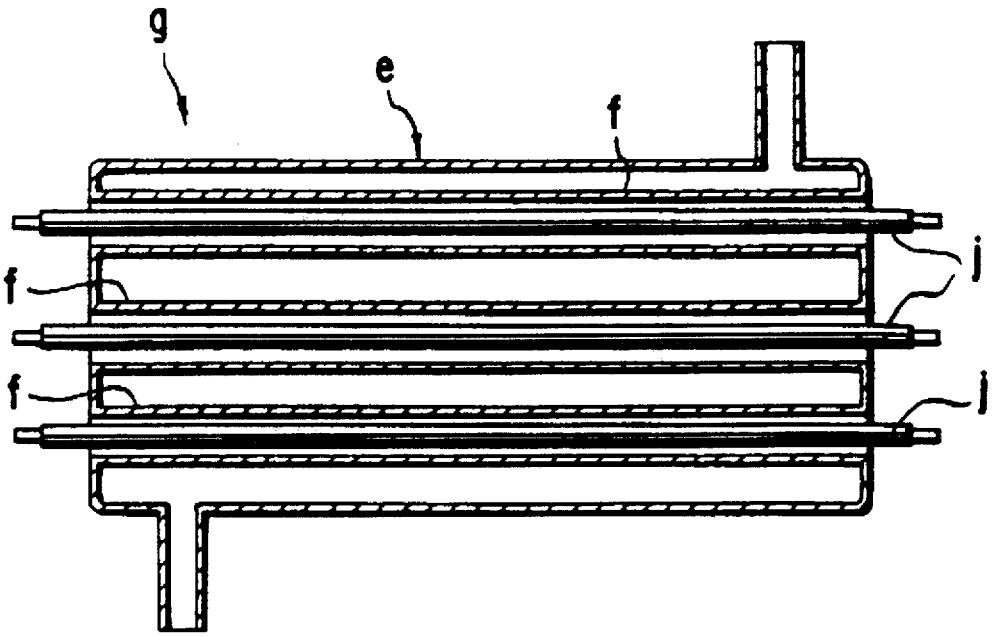
FIG. 3 is a sectional view showing a conventional example in which a plurality of inner tubes are arranged in an outer tube made of quartz glass and halogen lamps are detachably disposed in the inner tubes.
Figure 4:
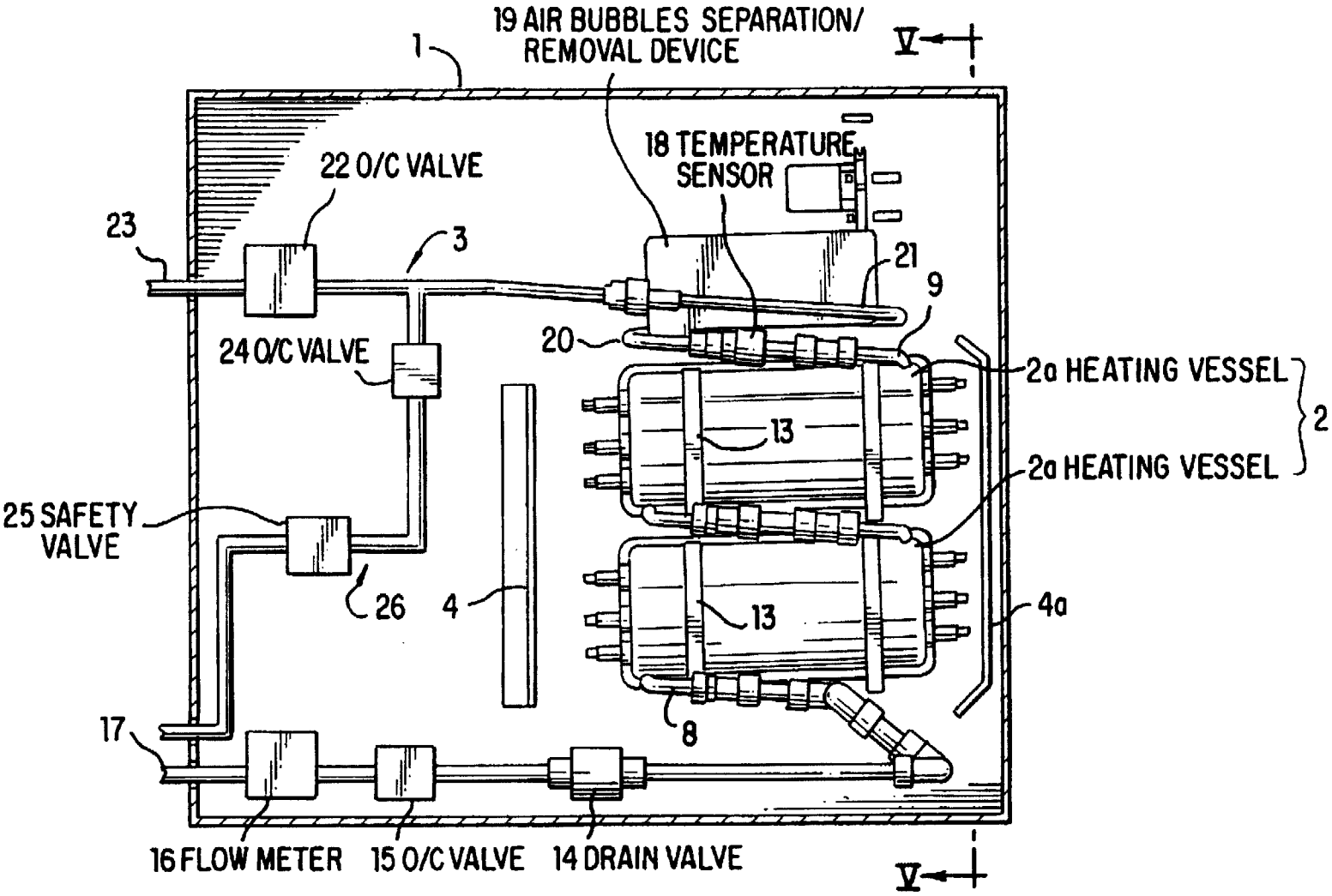
FIG. 4 is a sectional view representing a schematic arrangement of one embodiment of a fluid heating apparatus according to the present invention.
Figure 5:
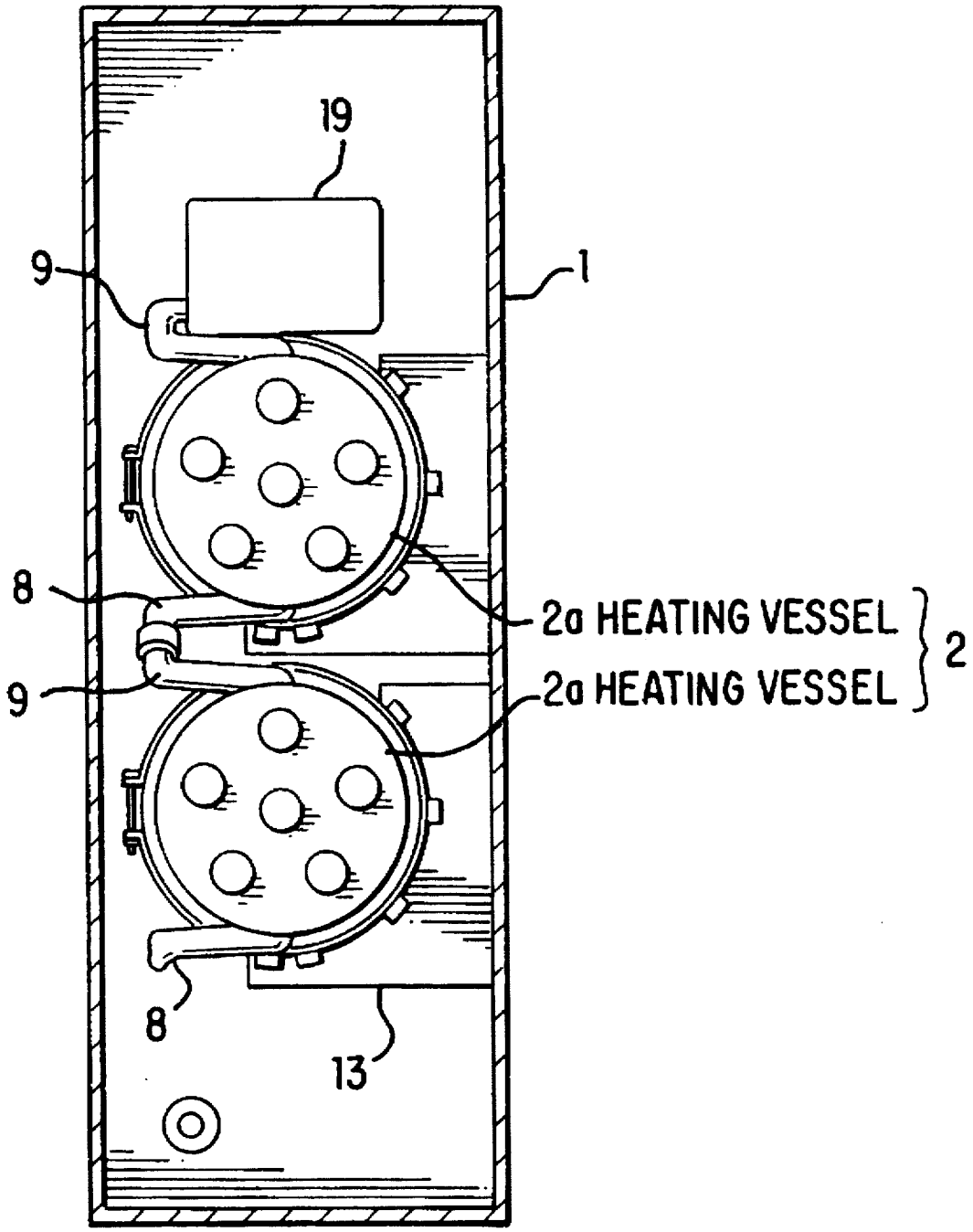
FIG. 5 is a schematic sectional view taken along the line V—V in FIG. 4.

The respective heating vessels 2*a* each having the structure mentioned hereinbefore are mounted to the casing 1 as shown in FIG. 4 by means of attaching members 13. In such time, when a plurality of heating vessels 2*a* are disposed, they are arranged vertically as viewed in FIG. 3.

In such arrangement, each of the heating vessels 2*a* is inclined in the same (parallel) direction so that the end portion to which the base end portion of the flow-out tube 9 is connected is positioned to a level higher than that of the other end portion. This inclination is made to, for example, 3° which is smaller than the inclination of 6°–8° of the flow-in tube 8 and flow-out tube 9. This inclination of 3° satisfies the use condition of the halogen lamp 10 which is less than allowable setting angle 5°, and although the inclination 6°–8° of the flow-in tube 8 and flow-out tube 9 is reduced by the inclination corresponding to the inclination of 3° of the one end of the heating vessel 2*a*, the inclination angle of 3°–5° is still kept. Accordingly, the fluids passing the heating vessels 2*a* pass flow passages having the same upward inclinations, respectively.

The flow-out tube 9 of one heating vessel 2*a* is connected to the flow-in tube 8 of the adjacent heating vessel 2*a* by a known connection pipe.

The flow-in tube 8 of the heating vessel 2*a* of the lowest side (most upstream side) is connected to a flow-in line 17 provided with a drain valve 14, open/close valve 15 and a flow meter 16. On the other hand, the flow-out tube 9 of the heating vessel 2*a* of the uppermost side (most downstream side) is connected to a flow-in tube 20 of an air-bubble separation/removal device 19 through a temperature sensor 18, and a flow-out line 23 provided with an open/close valve 22 is connected to a flow-out tube 21 of the air-bubble separation/removal device 19. To the upstream side of the open/close valve 22 of the flow-out line 23 there is connected a safety line 26 provided with an open/close valve 24 and a safety valve 25.

The aforementioned flow-in line 17 and flow-out line 23 are positioned to the lower side and the upper side of the respective heating vessels 2*a* and extend sideways beyond the locations of the heating vessels 2*a*, and the respective equipments of the fluid supply adjusting unit 3 such as the open/close valves 15, the flow meters 16 and the safety valves 25 in the respective flow lines are all arranged on the other side portion in the casing 1 partitioned by a heat shield plate 4 with respect to the heating unit 2.

The flow-in tubes 8 and the flow-out tubes 9 of the respective heating vessels 2*a* are arranged in an offset manner to one side with respect to the vertical central axis in the sectional view, but an offset amount will be made minimum in a range wherein joint tubes 13 attached to the flow-in tubes 8 and the flow-out tubes 9 do not interfere with the outer tube 6.

The air-bubble separation/removal device 19 is arranged with an inclination substantially parallel to the heating vessel 2*a*, and the flow-in tube 20 and the flow-out tube 21 of the air-bubble separation/removal device 19 are also inclined in the same manner as those of the flow-in tube 8 and the flow-out tube 9 of the heating vessel 2*a*. That is, the fluid flow passage of this air-bubble separation/removal device 19 is also inclined.

Further, on the side opposite to the heat shield plate 4 of the heating unit 2, another heat shield plate 4*a* is disposed. The outer peripheries of the respective heating vessels 2*a* may be covered with a heat insulating material as occasion demands.

Next, an operation of the fluid heating apparatus will be described hereunder.

According to the structures described above, the fluid having flowed through the flow-in line 17 passes the flow meters 16, the open/close valves 15 and the drain valves 14 and subsequently to the respective heating vessels 2*a*, 2*a*, and during this flowing, the fluid is heated by the halogen lamps 10 disposed inside the inner tubes 7. The air-bubbles are then separated and removed by the air-bubble separation/removal device 19, and thereafter, the fluid flows out through the open/close valve 22 of the flow-out line 23.

At such operation, the heating vessels 2*a* are inclined within the allowable setting angle of the halogen lamps 10, and moreover, the flow-in tubes 8 and the flow-out tubes 9 of the heating vessels 2*a* are also inclined with the downstream sides thereof being upward, so that the fluid passing through the heating vessels 2*a* flow smoothly in the heating vessels 2*a* without forming any liquid staying and air staying.

Finally, the air-bubbles are collectively separated and removed by the separation/removal device 19.

Since the base end portions of the flow-in tube 8 and the flow-out tube 9 of each heating vessel 2*a* are connected to the outer tube 6 in the tangential direction, the fluid flowing in and out of the heating vessel 2*a* gyrates, and the diffusion of the heat can be hence promoted, thus effectively heating the fluid.

Further, the halogen lamp 10 constituting a heater is easily dismounted and exchanged by disengaging the supporting member 12.

Furthermore, since the halogen lamp 10 is supported by the spring-shaped supporting member 12 and the seal portion 11 of the halogen lamp 10 is completely exposed externally from the inner tube 7, the body portion of the halogen lamp 10 and the seal portion 11 thereof are subjected to effective ventilation and thus can be cooled effectively.

In the above-mentioned embodiment, there is described an example in which the fluid supply adjusting unit 3 is arranged apart sideway of the heating unit 2, but the fluid supply adjusting unit 3 may be arranged vertically from the side of the heating unit 2. Further, in the above embodiment, there is provided an example in which two heating vessels 2*a* constituting the heating unit 2 are used, but one or more than two heating vessels 2*a* may be used, and in use of the plural heating vessels, the heating vessels are arranged vertically as mentioned above with reference to the preferred embodiment. Further, the air-bubble separation/removal device 19 may be disposed, in place of the directly downstream side of the heating vessel 2*a*, to another portion in the line arrangement.

It is to be noted that although the present invention was explained through the exemplary embodiment, it is obvious to those skilled in the art that it is possible to make various alternation, deletion and addition without departing from the subject and the scope of the present invention. Accordingly, it should be understood that the present invention is not limited only to the described embodiment and includes a scope prescribed by the elements recited in claims and equivalent elements thereof.

POSSIBILITY OF INDUSTRIAL USAGE

As described hereinbefore, the fluid heating apparatus according to the present invention is extremely useful for a heating apparatus for pure water and chemicals.

We claim:

1. A fluid heating apparatus comprising a casing having a first portion containing a heating unit, a second portion containing a fluid supply adjusting unit and a heat shield plate disposed between said first and said second portions, wherein said heating unit and said fluid supply adjusting unit are in fluid communication by way of an inlet tube to the heating unit and an outlet tube from the heating unit, and said second portion of the casing is adjacent to, but separated from, said first portion of the casing.

2. A fluid heating apparatus according to claim 1, wherein said heating unit comprises a plurality of heating vessels having a flow-in tube and a flow out tube, wherein a flow-in tube of one of said heating vessels is connected to a flow-out tube of another one of the heating vessels adjacent thereto.

3. A fluid heating apparatus according to claim 1, wherein each of the heating vessels comprise an outer tuber a flow-in tube and a flow-out tube, wherein said flow-in tube and said flow-out tube are tangentially attached to the outer tube and portions of said flow-in tube and said flow-out tube attached to said outer tube are bent.

4. A fluid heating apparatus according to claim 2, wherein each of the heating vessels comprises an outer tube, wherein said flow-in tube and said flow-out tube are tangentially attached to the outer tube and portions of said flow-in tube and said flow-out tube attached to said outer tube are bent.

5. The fluid heating apparatus according to claim 1 wherein the heat shield plate is a solid heat shield plate.

6. The fluid heating apparatus according to claim 3 wherein the flow-in tube and flow-out tube are horizontally inclined relative to the outer tube and the bent portions of said flow-in tube and said flow-out tubes are inclined relative to the outer tube such that the tangential inclination of the bent portion is less than the horizontal inclination of the tubes.

7. The fluid heating apparatus according to claim 4 wherein the flow-in tube and flow-out tube are horizontally inclined relative to the outer tube and the bent portions of said flow-in tube and said flow-out tubes are inclined relative to the outer tube such that the tangential inclination of the bent portion is less than the horizontal inclination of the tubes.

8. A fluid heating apparatus comprising a casing containing a heating unit comprising at least one heating vessel, and a fluid supply adjusting unit, wherein:

(i) said heating unit and said fluid supply adjusting unit are in fluid connection through an inlet tube to said heating unit and outlet tube from said heating unit, and (ii) each of said heating vessels comprises an outer tube, a flow-in tube and a flow-out tube wherein said flow-in tube and said flow-out tube are tangentially attached to the outer tube, and portions of said flow-in tube and said flow-out tube attached to said outer tube are bent.

9. A fluid heating apparatus comprising a casing having a first portion containing a heating unit containing a plurality of heating vessels, and a second portion containing a fluid supply adjusting unit, said heating unit and said fluid supply adjusting unit being in fluid connection through an inlet tube to the heating unit and an outlet tube from the heating unit, wherein:

(i) an axis of the heating unit is inclined with regard to a vertical direction, (ii) each of said heating vessels includes a flow-in tube connected to a lower surface of a lower end portion of the heating vessel and a flow-out tube connected to an upper surface of an upper end portion of the heating vessel, with said flow-in tubes and said flow-out tube being inclined so that downstream sides of said flow-in tubes and said flow-out tubes are positioned higher than upstream sides of said flow-in tube and said flow-out tubes, and (iii) the second portion of the casing is adjacent to, but separated from, said first portion.

10. A fluid heating apparatus according to claim 9, wherein an air-bubble separation/removal device is disposed in fluid communication with the heating unit on a downstream side of the heating unit.

11. A fluid heating apparatus according to claim 9, wherein a heat shield plate is disposed between said heating unit and said fluid supply adjusting unit.

12. A fluid heating apparatus according to claim 9, wherein each of the heating vessels comprises an outer tube, wherein said flow-in tube of the heating vessel and said flow-out tube of the heating vessel are tangentially attached to the outer tube and portions of said flow-in tube and said flow-out tube attached to said outer tube are bent.

13. The fluid heating apparatus according to claim 12 wherein the flow-in tube and flow-out tubes are horizontally inclined relative to the outside tube and the bent portions of said flow-in tube and said flow-out tubes are tangentially inclined relative to the outer tube such that the tangential inclination of the bent portions is less than the horizontal inclination of the tubes.

14. A fluid heating apparatus according to any one of claims 9, 12, 8, and 3–4, wherein each of the heating vessels further comprises an inner tube disposed inside the outer tube, and a heater disposed inside the inner tube, and further wherein:

(i) the heating vessel comprises a quartz glass material;

(ii) the outside tube is closed at both ends by side plates and the inner tube penetrates through the side plates and (ii) said fluid supply adjusting unit comprises a line for supplying a fluid to the heating unit, and an open/close valve, a flow meter, a temperature sensor, a safety valve and a joint tube are provided for the line.

15. A fluid apparatus according to claim 14, wherein a halogen lamp is utilized as said heater, both ends of the halogen lamp are supported by said inner tube through a spring-shaped supporting member, and seal portions projecting from both the ends are completely exposed externally of said inner tube.

* * * * *